US011986011B1

(12) United States Patent
Law, Jr. III

(10) Patent No.: US 11,986,011 B1
(45) Date of Patent: May 21, 2024

(54) TOBACCO LEAF ROLLING PAPER

(71) Applicant: Sirgradykc Law, Jr. III, Nashua, NH (US)

(72) Inventor: Sirgradykc Law, Jr. III, Nashua, NH (US)

( * ) Notice: Subject to any disclaimer, the term of this patent is extended or adjusted under 35 U.S.C. 154(b) by 337 days.

(21) Appl. No.: 17/533,251

(22) Filed: Nov. 23, 2021

(51) Int. Cl.
*A24D 1/00* (2020.01)
*A24D 1/02* (2006.01)

(52) U.S. Cl.
CPC ..... *A24D 1/022* (2013.01); *A24D 1/025* (2013.01)

(58) Field of Classification Search
None
See application file for complete search history.

(56) References Cited

U.S. PATENT DOCUMENTS

| | | | | |
|---|---|---|---|---|
| 4,114,629 | A | 9/1978 | Sedlacek | |
| D408,580 | S | 4/1999 | Archetto | |
| 6,321,755 | B1 | 11/2001 | Sinclair, Jr. | |
| 9,113,658 | B1 | 8/2015 | Sinclair, Jr. | |
| 2005/0000531 | A1* | 1/2005 | Shi | A24B 15/287 131/347 |
| 2005/0121341 | A1 | 6/2005 | Darwish | |
| 2018/0027869 | A1 | 2/2018 | Scott | |
| 2018/0077964 | A1* | 3/2018 | Farmer | A24D 1/022 |

FOREIGN PATENT DOCUMENTS

| | | |
|---|---|---|
| WO | 2017068437 | 4/2017 |

OTHER PUBLICATIONS

Rawat et al,Phytochemical Properties and Pharmacological Activities of Nicotiana Tabacum, Indian J. of Pharmaceutical & Biological Research. vol. 1 (1), 2013, pp. 74-81,[online],retrieved from the Internet,[retrieved Dec. 13, 2023, (Year: 2013).*
Continuation of U:<URL:https://www.researchgate.net/publication/324677919_Phytochemical_Properties_and_Pharmcological_Activities_of_Nicotiana_Tabacum>. (Year: 2013).*

* cited by examiner

*Primary Examiner* — Dennis R Cordray
(74) *Attorney, Agent, or Firm* — Kyle A. Fletcher, Esq.

(57) ABSTRACT

The smoking material rolling paper is a containment structure. The smoking material rolling paper is configured for use with a smoking material. The smoking material is defined elsewhere in this disclosure. The smoking material rolling paper contains the smoking material in preparation for consumption. The smoking material rolling paper comprises a sheeting structure, a pocket structure, and an adhesive coating. The adhesive coating is applied to the sheeting structure. The pocket structure is formed in the sheeting structure. The adhesive coating holds the sheeting structure in a closed position that fully contains the smoking material within the smoking material rolling paper.

15 Claims, 4 Drawing Sheets

TOBACCO LEAF ROLLING PAPER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of cigarettes with a special structure, more specifically, a cover with a special composition and structure. (A24D1/02)

SUMMARY OF INVENTION

The smoking material rolling paper is a containment structure, which may include a plurality of flavors integrated therein. The smoking material rolling paper is configured for use with a smoking material. The smoking material is defined elsewhere in this disclosure. The smoking material rolling paper contains the smoking material in preparation for consumption. The smoking material rolling paper comprises a sheeting structure, a pocket structure, and an adhesive coating. The adhesive coating is applied to the sheeting structure. The pocket structure is formed in the sheeting structure. The adhesive coating holds the sheeting structure in a closed position that fully contains the smoking material within the smoking material rolling paper.

These together with additional objects, features and advantages of the smoking material rolling paper will be readily apparent to those of ordinary skill in the art upon reading the following detailed description of the presently preferred, but nonetheless illustrative, embodiments when taken in conjunction with the accompanying drawings.

In this respect, before explaining the current embodiments of the smoking material rolling paper in detail, it is to be understood that the smoking material rolling paper is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the smoking material rolling paper.

It is therefore important that the claims be regarded as including such equivalent construction insofar as they do not depart from the spirit and scope of the smoking material rolling paper. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
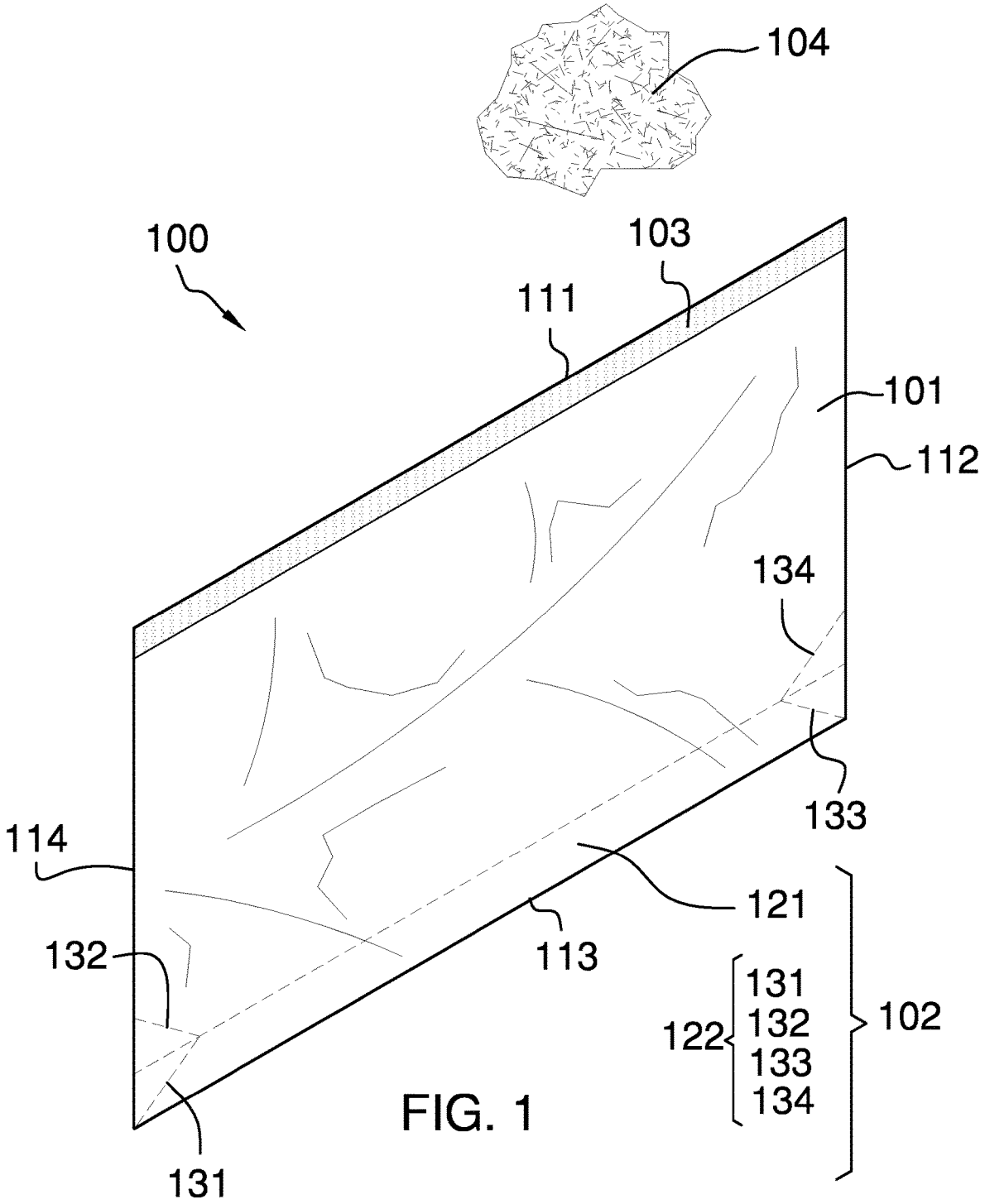
FIG. 1 is a perspective view of an embodiment of the disclosure.
Figure 2:
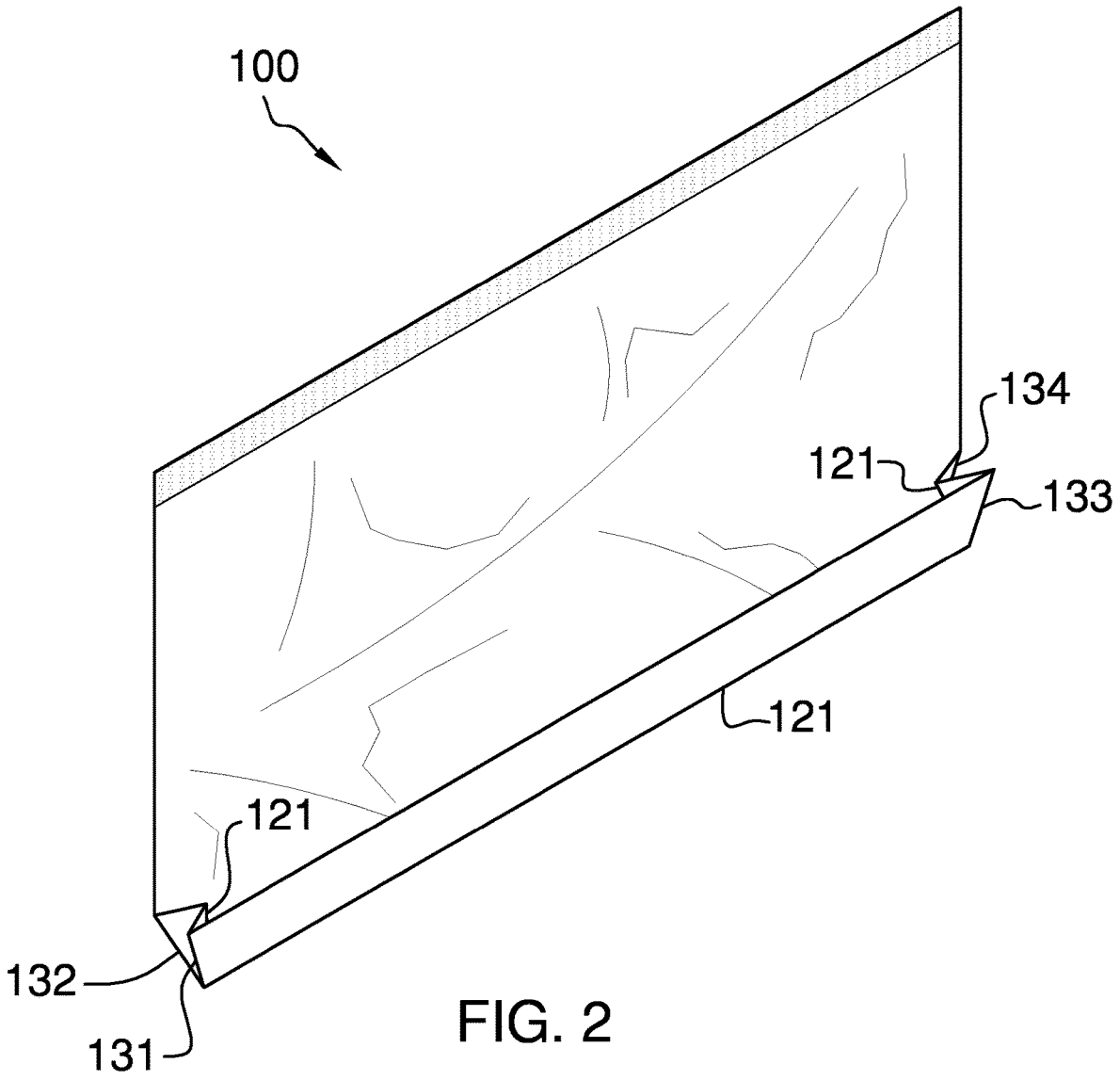
FIG. 2 is a perspective view of an embodiment of the disclosure.
Figure 3:
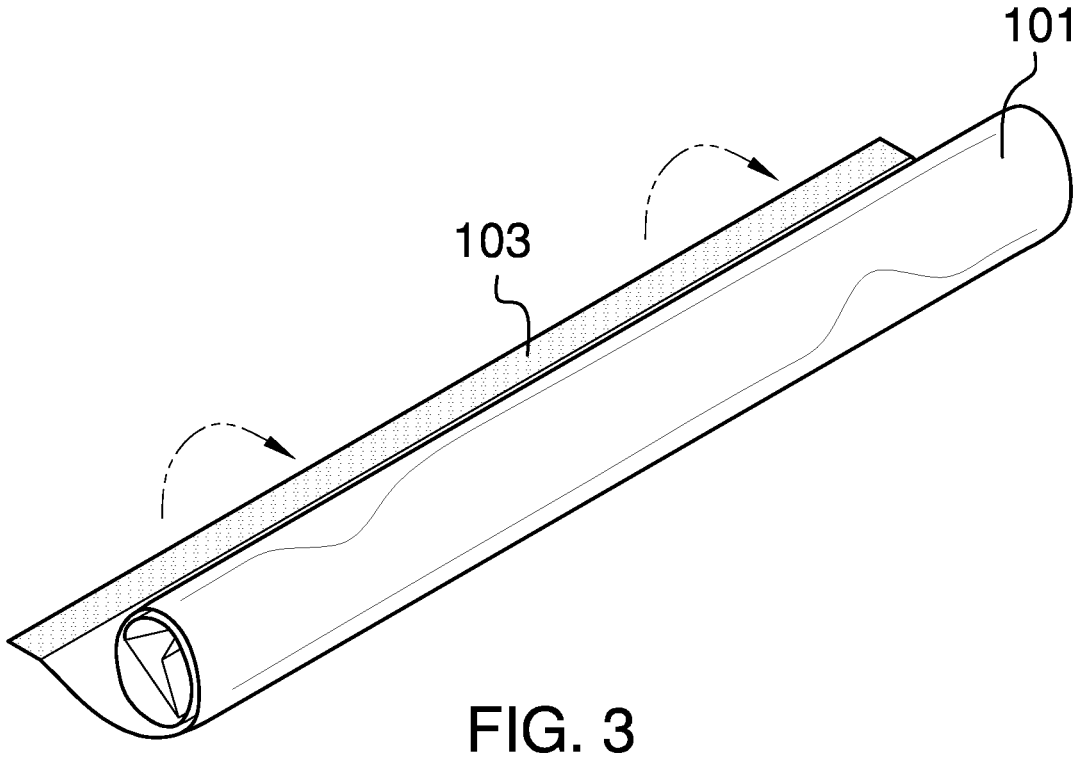
FIG. 3 is an in-use view of an embodiment of the disclosure.
Figure 4:
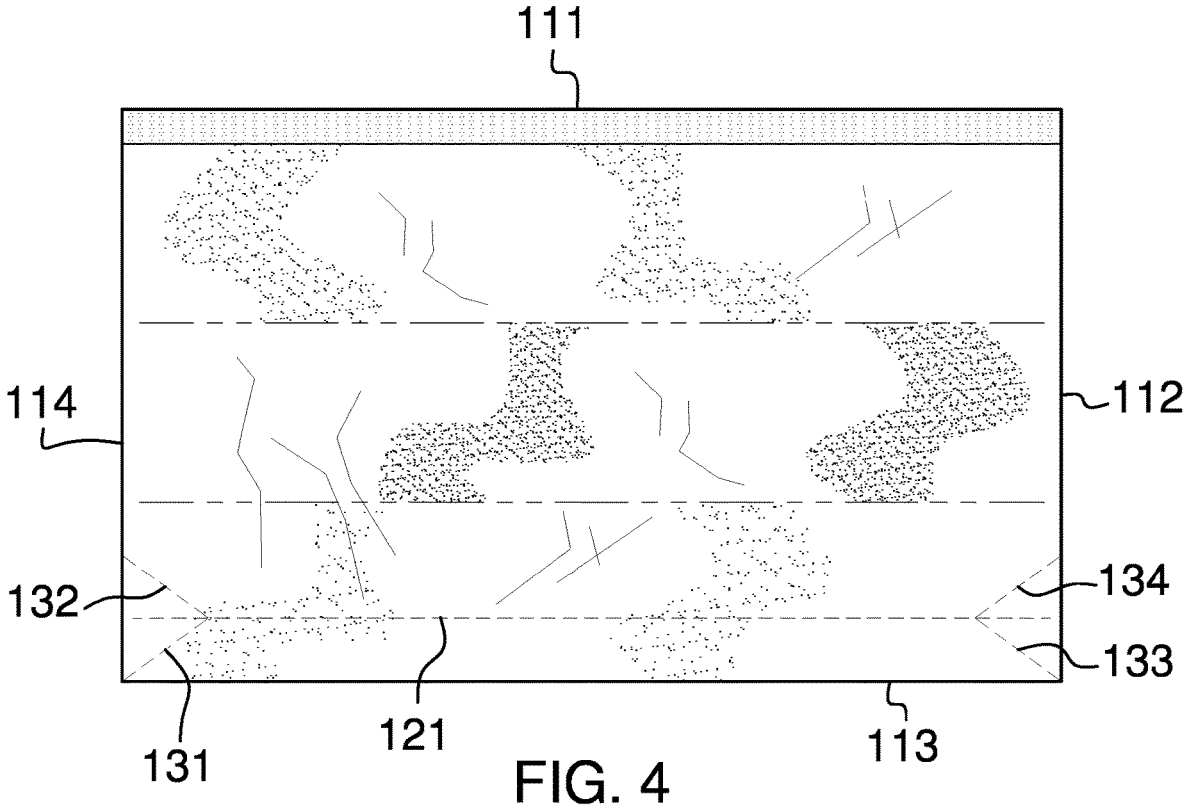
FIG. 4 is a front view of an embodiment of the disclosure.

Detailed reference will now be made to one or more potential embodiments of the disclosure, which are illustrated in FIGS. 1 through 4.

The smoking material rolling paper 100 (hereinafter invention) is a containment structure. The invention 100 is configured for use with a smoking material 104. The smoking material 104 is defined elsewhere in this disclosure. The invention 100 contains the smoking material 104 in preparation for consumption. The invention 100 comprises a sheeting structure 101, a pocket structure 102, and an adhesive coating 103. The adhesive coating 103 is applied to the sheeting structure 101. The pocket structure 102 is formed in the sheeting structure 101. The adhesive coating 103 holds the sheeting structure 101 in a closed position that fully contains the smoking material 104 within the invention 100.

The smoking material 104 is a pharmacologically active media. The smoking material 104 is a phytochemical based structure. The smoking material 104 is processed through a combustion reaction in preparation for inhalation. The smoking material 104 is defined elsewhere in this disclosure.

The sheeting structure 101 is a sheeting. The sheeting structure 101 has a rectangular shape. The sheeting structure 101 is a disposable structure. The sheeting structure 101 is a combustible structure. The sheeting structure 101 is formed from plant based materials. In the first potential embodiment of the disclosure, the sheeting structure 101 is formed from tobacco leaves. The sheeting structure may include a plurality of flavors that impart a taste or smell when used. Also, different designs or indicia may be imprinted on the sheeting structure 101.

The sheeting structure 101 forms a containment shell used to store the smoking material 104 in anticipation of use. The sheeting structure 101 forms a pocket structure 102 that contains the smoking material 104. The sheeting structure 101 wraps around the smoking material 104 to form a prism shaped structure that fully encloses the smoking material 104. A congruent end of the prism shaped containment structure formed by the sheeting structure 101 is ignited to initiate a combustion reaction that consumes the smoking material 104 and the sheeting structure 101 in preparation for inhalation.

The sheeting structure 101 comprises a first edge 111, a second edge 112, a third edge 113, and a fourth edge 114. The first edge 111 is the edge of the face of the sheeting structure 101 with the greatest span of length. The second edge 112 is the edge of the face of the sheeting structure 101 with the least span of length. The third edge 113 is the edge of the face of the sheeting structure 101 that is distal from the first edge 111. The fourth edge 114 is the edge of the face of the sheeting structure 101 that is distal from the second edge 112.

The pocket structure 102 is a containment structure formed within the sheeting structure 101. The pocket structure 102 forms a pan shaped structure. The pan structure of the pocket structure 102 contains the smoking material 104 in preparation for rolling the smoking material 104 within the sheeting structure 101 to fully enclose the smoking material 104 within the sheeting structure 101. The pocket structure 102 comprises a master fold line 121 and a triangular fold structure 122.

The master fold line 121 is a crease that is formed in the sheeting structure 101. The master fold line 121 forms a crease line that runs parallel to the third edge 113 of the sheeting structure 101. The master fold line 121 runs from the second edge 112 of the sheeting structure 101 to the fourth edge 114 of the sheeting structure 101. The span of the length of a line that is perpendicular to both the master fold line 121 and the third edge 113 is lesser than the span of the length of a line that is perpendicular to both the first edge 111 and the master fold line 121. The crease formed in the sheeting structure 101 at the master fold line 121 forms the inferior containment surfaces that support the smoking material 104 during the preparation process.

The triangular fold structure 122 form the vertical surfaces that enclose the smoking material 104 within the sheeting structure 101. The triangular fold structure 122 is formed from a plurality of containment folds. The triangular fold structure 122 from the congruent ends of the prism structure of the invention 100 after the smoking material 104 has been enclosed within the sheeting structure 101. The triangular fold structure 122 comprises a first containment fold 131, a second containment fold 132, a third containment fold 133, and a fourth containment fold 134.

The first containment fold 131 is a crease line that is formed in the sheeting structure 101. The first containment fold 131 forms a straight line that runs: a) from the vertex formed by the third edge 113 and the fourth edge 114 of the sheeting structure 101 to a first point located on the master fold line 121.

The second containment fold 132 is a crease line that is formed in the sheeting structure 101. The second containment fold 132 forms a straight line that runs: a) from a second point on the fourth edge 114 of the sheeting structure 101 to the first point on the master fold line 121. The second point on the fourth edge 114 of the sheeting structure 101 is the point that has a span of distance from the master fold line 121 that is equal to the span of distance between the master fold line 121 and the vertex formed by the third edge 113 and the fourth edge 114.

The first containment fold 131 is positioned relative to the second containment fold 132 such that the master fold line 121 bisects the angle between the first containment fold 131 and the second containment fold 132.

The third containment fold 133 is a crease line that is formed in the sheeting structure 101. The third containment fold 133 forms a straight line that runs: a) from the vertex formed by the third edge 113 and the second edge 112 of the sheeting structure 101 to a third point located on the master fold line 121.

The fourth containment fold 134 is a crease line that is formed in the sheeting structure 101. The fourth containment fold 134 forms a straight line that runs: a) from a fourth point on the second edge 112 of the sheeting structure 101 to the second point on the master fold line 121. The fourth point on the second edge 112 of the sheeting structure 101 is the point that has a span of distance from the master fold line 121 that is equal to the span of distance between the master fold line 121 and the vertex formed by the third edge 113 and the second edge 112.

The third containment fold 133 is positioned relative to the fourth containment fold 134 such that the master fold line 121 bisects the angle between the third containment fold 133 and the fourth containment fold 134.

To enclose the triangular fold structure 122, the master fold line 121 is pushed at the fourth edge 114 into the smoking material 104 that is contained in the pocket structure 102 such that first containment fold 131 and the second containment fold 132 fold to form the first congruent end of containment structure of the sheeting structure 101. To complete enclosing the triangular fold structure 122, the master fold line 121 is pushed at the second edge 112 into the smoking material 104 that is contained in the pocket structure 102 such that third containment fold 133 and the fourth containment fold 134 fold to form the second congruent end of containment structure of the sheeting structure 101.

The adhesive coating 103 is a pressure sensitive adhesive that is applied as a coating to a face of the sheeting structure 101. The adhesive coating 103 secures the sheeting structure 101 to itself. The adhesive coating 103 seals the sheeting structure 101 in a closed position after the smoking material 104 has been enclosed within the sheeting structure 101. The adhesive coating 103 is activated by the application of pressure to the adhesive coating 103 after the enclosure of the smoking material 104. The adhesive coating 103 is applied as a coating along the first edge 111 of the sheeting structure 101.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Closed Position: As used in this disclosure, a closed position refers to a rotating structure that is in an orientation that prevents access to the contents of the structure. The closed position is often referred to as an object being "closed."

Coating: As used in this disclosure, a coating refers to a substance that is applied to the exterior surface of an object such that the coating forms a new exterior surface of the object. A coating is commonly said to be formed as a layer. Paint is an example of a common coating material.

Combustion: As used in this disclosure, combustion refers to a reduction-oxidation reaction wherein oxygen and a hydrocarbon are combined to release energy, carbon dioxide, and water. In general usage, the meaning of combustion is often extended to describe a reaction between oxygen and a fuel source, such as a hydrocarbon modified by functional groups, which releases energy.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Crease: As used in this disclosure, a crease is a (typically linear) structure that is formed in a surface by the folding of the surface. A crease is often formed as a "prefold" formed in a surface that is intended to be subsequently folded. This "prefold" helps to guide the formation of the crease when the surface is subsequently folded for its intended use.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Disposable: As used in this disclosure, disposable is an adjective that refers to an object that is designed and intended for a single use. Within this context, an object would be considered disposable if it is not reusable after its initial use.

Exterior: As used in this disclosure, the exterior is used as a relational term that implies that an object is not contained within the boundary of a structure or a space.

Flexible: As used in this disclosure, flexible refers to an object or material that will deform when a force is applied to it but that will not necessarily return to its original shape when the deforming force is removed.

Fold: As used in this disclosure, to fold means to bend an object back upon itself.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Interior: As used in this disclosure, the interior is used as a relational term that implies that an object is contained within the boundary of a structure or a space.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Open Position: As used in this disclosure, an open position refers to a rotating structure that is in an orientation that allows access to the contents of the structure. The open position is often referred to as an object being "open."

Orientation: As used in this disclosure, orientation refers to the positioning of a first object relative to: 1) a second object; or, 2) a fixed position, location, or direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Paper: As used in this disclosure, paper refers to a sheeting material commonly used as: a) a substrate on which people write; b) a substrate on which images are displayed; and, c) wrapping or covering items. Paper is typically made from plant fibers such as cellulose. Paper intended for specific purposes may be made from other materials.

Perimeter: As used in this disclosure, a perimeter is one or more curved or straight lines that bounds an enclosed area on a plane or surface. The perimeter of a circle is commonly referred to as a circumference.

Pharmacologically Active Media: As used in this disclosure, a pharmacologically active media refers to a chemical substance that has a biochemical or physiological effect on a biological organism.

Pocket: As used in this disclosure, a pocket is a storage space that is formed on or into an object.

Pressure Sensitive Adhesive: As used in this disclosure, a pressure sensitive adhesive is an adhesive that is a permanently tacky adhesive that is activated by the application of pressure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Reduction-Oxidation Reaction: As used in this disclosure, a reduction-oxidation reaction (also known as a redox reaction) is a chemical reaction involving the transfer of electrons between the reactants of the reaction.

Roll: As used in this disclosure, the term roll refers to the rotation of an object around an axis or center of rotation.

Sheeting: As used in this disclosure, a sheeting is a material, such as a paper, textile, a plastic, or a metal foil, in the form of a thin flexible layer or layers. The sheeting forms a disk structure. The two surfaces of the sheeting with the greatest surface area are called the faces of the sheeting.

Smoking Material: As used in this disclosure, smoking materials are combustible materials that are intended to be deeply inhaled as the smoking material burns. This definition is intended to include, but is not limited to, tobacco and pharmacologically active media that exhibit pharmacological activity such as marijuana. This definition is intended to include vaporizing devices commonly used to evaporate or sublimate materials into a gas phase that simulate the smoking experience. This definition is intended to exclude combustible materials that are burned as a perfume but that are generally not purposefully inhaled including, but not limited to, incense and scented oils.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A paper for rolling smoking material comprising
- a sheeting structure, a pocket structure, and an adhesive coating;
- wherein the adhesive coating is applied to the sheeting structure;
- wherein the pocket structure is formed in the sheeting structure;
- wherein the paper for rolling smoking material is configured for use with a smoking material;
- wherein the adhesive coating holds the sheeting structure in a closed position that fully contains the smoking material within the paper for rolling smoking material;
- wherein the sheeting structure includes at least one flavor that imparts a taste or smell when used;
- wherein the pocket structure comprises a master fold line and a triangular fold structure;
- wherein the master fold line is a crease that is formed in the sheeting structure;
- wherein the triangular fold structure is rolled to form vertical surfaces that enclose the smoking material within the sheeting structure.

2. The paper for rolling smoking material according to claim 1
- wherein the paper for rolling smoking material is a containment structure;
- wherein the paper for rolling smoking material is configured to contain the smoking material.

3. The paper for rolling smoking material according to claim 2
- wherein the smoking material is a pharmacologically active media;
- wherein the smoking material is a phytochemical based structure;
- wherein the smoking material is processed through a combustion reaction in preparation for inhalation.

4. The paper for rolling smoking material according to claim 3
- wherein the sheeting structure is a sheeting;
- wherein the sheeting structure has a rectangular shape;
- wherein the sheeting structure is a disposable structure;
- wherein the sheeting structure is a combustible structure;
- wherein the sheeting structure is formed from plant based materials.

5. The paper for rolling smoking material according to claim 4
- wherein the sheeting structure forms a containment shell used to store the smoking material;
- wherein the sheeting structure wraps around the smoking material to form a structure that fully encloses the smoking material.

6. The paper for rolling smoking material according to claim 5
- wherein the sheeting structure comprises a first edge, a second edge, a third edge, and a fourth edge;
- wherein the first edge is an edge of the sheeting structure with the greatest span of length;
- wherein the second edge is an edge of the sheeting structure with the least span of length;

wherein the third edge is the edge of the sheeting structure that is distal from the first edge;

wherein the fourth edge is the edge of the sheeting structure that is distal from the second edge.

7. The paper for rolling smoking material according to claim 6 wherein the pocket structure is a containment structure formed within the sheeting structure;

wherein the pocket structure forms a pan shaped structure;

wherein the pan structure of the pocket structure contains the smoking material in preparation for rolling the smoking material within the sheeting structure to fully enclose the smoking material within the sheeting structure.

8. The paper for rolling smoking material according to claim 7 wherein the master fold line forms a crease line that runs parallel to the third edge of the sheeting structure;

wherein the master fold line runs from the second edge of the sheeting structure to the fourth edge of the sheeting structure;

wherein a span of a length of a line that is perpendicular to both the master fold line and the third edge is less than a span of a length of a line that is perpendicular to both the first edge and the master fold line;

wherein the crease formed in the sheeting structure at the master fold line forms the interior containment surfaces that support the smoking material during the preparation process.

9. The paper for rolling smoking material according to claim 7 wherein the triangular fold structure is formed from a plurality of containment folds;

wherein the triangular fold structure forms congruent ends of the paper for rolling smoking material after the smoking material has been enclosed within the sheeting structure.

10. The paper for rolling smoking material according to claim 9 wherein the triangular fold structure comprises a first containment fold, a second containment fold, a third containment fold, and a fourth containment fold;

wherein the first containment fold is a crease line that is formed in the sheeting structure;

wherein the second containment fold is a crease line that is formed in the sheeting structure;

wherein the third containment fold is a crease line that is formed in the sheeting structure;

wherein the fourth containment fold is a crease line that is formed in the sheeting structure.

11. The paper for rolling smoking material according to claim 10 wherein the first containment fold forms a straight line that runs: a) from the vertex formed by the third edge and the fourth edge of the sheeting structure to a first point located on the master fold line;

wherein the second containment fold forms a straight line that runs: a) from a second point on the fourth edge of the sheeting structure to the first point on the master fold line;

wherein the third containment fold forms a straight line that runs: a) from the vertex formed by the third edge and the second edge of the sheeting structure to a third point located on the master fold line; wherein the fourth containment fold forms a straight line that runs: a) from a fourth point on the second edge of the sheeting structure to the third point on the master fold line.

12. The paper for rolling smoking material according to claim 11 wherein the second point on the fourth edge of the sheeting structure is the point that has a span of distance from the master fold line that is equal to the span of distance between the master fold line and the vertex formed by the third edge and the fourth edge;

wherein the fourth point on the second edge of the sheeting structure is the point that has a span of distance from the master fold line that is equal to the span of distance between the master fold line and the vertex formed by the third edge and the second edge.

13. The paper for rolling smoking material according to claim 12 wherein the first containment fold is positioned relative to the second containment fold such that the master fold line bisects the angle between the first containment fold and the second containment fold;

wherein the third containment fold is positioned relative to the fourth containment fold such that the master fold line bisects the angle between the third containment fold and the fourth containment fold.

14. The paper for rolling smoking material according to claim 13 wherein the adhesive coating is a pressure sensitive adhesive that is applied as a coating to a face of the sheeting structure;

wherein the adhesive coating secures the sheeting structure to itself;

wherein the adhesive coating seals the sheeting structure in a closed position after the smoking material has been enclosed within the sheeting structure;

wherein the adhesive coating is activated by the application of pressure to the adhesive coating after the enclosure of the smoking material;

wherein the adhesive coating is applied as a coating along the first edge of the sheeting structure.

15. The paper for rolling smoking material according to claim 14 wherein the sheeting structure is formed from tobacco leaves.

* * * * *